US011242168B2

(12) United States Patent
Junga et al.

(10) Patent No.: US 11,242,168 B2
(45) Date of Patent: Feb. 8, 2022

(54) DEVICE FOR MOVING A CUSHIONING MATERIAL INTO A TRANSPORT CONTAINER, AND METHOD FOR OPERATING SUCH A DEVICE

(71) Applicant: Storopack Hans Reichenecker GMBH, Metzingen (DE)

(72) Inventors: Torsten Junga, Pliezhausen (DE); René Kuhn, Ebersbach an der Fils (DE); Viktor Balasa, Fellbach (DE); Christoph Prinzler, Waltenhofen (DE)

(73) Assignee: Storopack Hans Reichenecker GMBH, Metzingen (DE)

( * ) Notice: Subject to any disclaimer, the term of this patent is extended or adjusted under 35 U.S.C. 154(b) by 0 days.

(21) Appl. No.: 16/980,024

(22) PCT Filed: Jan. 23, 2019

(86) PCT No.: PCT/EP2019/051542
§ 371 (c)(1),
(2) Date: Sep. 11, 2020

(87) PCT Pub. No.: WO2019/174800
PCT Pub. Date: Sep. 19, 2019

(65) Prior Publication Data

US 2021/0009295 A1 Jan. 14, 2021

(30) Foreign Application Priority Data

Mar. 14, 2018 (DE) ..... 10 2018 105 899.3

(51) Int. Cl.
*B65B 55/00* (2006.01)
*B65B 55/20* (2006.01)
*B05B 7/14* (2006.01)

(52) U.S. Cl.
CPC ..... *B65B 55/20* (2013.01); *B05B 7/1486* (2013.01); *B31D 2205/007* (2013.01);
(Continued)

(58) Field of Classification Search
CPC ..... B65B 55/20
See application file for complete search history.

(56) References Cited

U.S. PATENT DOCUMENTS 3,446,882 A * 5/1969 Landon ..... B29C 44/3461 264/45.4
3,450,253 A 6/1969 Nielsen
(Continued)

FOREIGN PATENT DOCUMENTS

DE 1511744 A1 9/1969
DE 10 2012 222 805 B3 6/2013
(Continued)

OTHER PUBLICATIONS

PCT/EP2019/051542, International Search Report, dated Mar. 25, 2019.
(Continued)

*Primary Examiner* — Eyamindae C Jallow
(74) *Attorney, Agent, or Firm* — Wood Herron & Evans LLP

(57) ABSTRACT

The invention relates to a device for moving a cushioning means towards a transport container, comprising a cushioning means dispensing device for the cushioning means and a transport container supply device for supplying the transport container. According to the invention, the cushioning means dispensing device has an ejection device which ejects the cushioning means out of the cushioning means dispensing device such that the cushioning means moves towards the supplied transport container along a ballistic trajectory which has a horizontal component at least temporarily.

8 Claims, 3 Drawing Sheets

(52) U.S. Cl.
CPC ..... *B31D 2205/0047* (2013.01); *B31D 2205/0058* (2013.01); *B31D 2205/0088* (2013.01)

(56) References Cited

U.S. PATENT DOCUMENTS 4,763,772 A * 8/1988 Gradoboev ..... B65G 33/04 198/398
5,199,244 A * 4/1993 Beier ..... B68G 7/06 141/67
5,236,507 A * 8/1993 Brown ..... B65B 55/20 118/302
5,623,815 A * 4/1997 Hornstein ..... B65D 81/09 53/472
5,699,645 A * 12/1997 Vaccarello ..... B65B 55/20 206/584
6,428,246 B1 * 8/2002 Landrum ..... B65G 51/02 226/118.5
2005/0210839 A1 * 9/2005 Sadakierski ..... B65G 51/02 53/473

FOREIGN PATENT DOCUMENTS

DE 102012218679 A1 4/2014
DE 10 2017 109 829 A1 11/2018
EP 1556278 B1 6/2006
WO 06089306 A1 8/2006
WO 2008/146111 A1 12/2008

OTHER PUBLICATIONS

PCT/EP2019/051542, Written Opinion.
Related application No. EP 19701507.6, Office Communication, dated Mar. 15, 2021.

* cited by examiner

DEVICE FOR MOVING A CUSHIONING MATERIAL INTO A TRANSPORT CONTAINER, AND METHOD FOR OPERATING SUCH A DEVICE

The invention relates to a device for moving a cushioning means into a transport container and to a method for operating such a device according to the preambles of the independent claims.

It is known from the market to arrange a cushioning means in a transport container in which objects are arranged for transport, in order to secure the objects in the transport container against slipping during transport and to protect said objects against damage, for example due to impact loads. This is particularly known in the mail order business, which protects the items to be shipped in this way. Cardboard boxes are usually used as transport containers and cushion pads made of a crumpled paper material that is initially in sheet form are used as cushioning means. A packer first places the objects to be shipped in the transport container and then additionally places the cushioning means in the transport container by hand before it is sealed and shipped. Examples of corresponding patent publications are DE 10 2012 222 805 B3 and DE 10 2012 218 679 A1. In addition, it is known from EP 1 556 278 B1, for example, to insert cushioning means into a transport container by means of a robot.

The object of the present invention is to provide a device and a method for moving a cushioning means into a transport container, by means of which device and method a large number of transport containers can be supplied with cushioning means within a predetermined unit of time.

This object is achieved by a device and by a method having the features of the independent claims. Developments are also specified in the dependent claims. Features essential to the invention can also be found in the following description and in the accompanying drawings. These features may be essential to the invention both alone and in different combinations, without this being explicitly referred to again.

According to the invention, a device for moving a cushioning means in the direction of a transport container is initially proposed, which device comprises a cushioning means dispensing device for the cushioning means and a transport container supply device for the transport container. The function of the cushioning means dispensing device is to dispense the cushioning means so that it can be transported towards the transport container. The transport container itself is supplied beforehand or at the same time, for example by being placed manually at a specific location on the transport container supply device, or by being positioned at a desired location by means of the transport container supply device.

According to the invention, the cushioning means dispensing device has an ejection device which ejects the cushioning means out of the cushioning means dispensing device such that the cushioning means moves towards the supplied transport container along a ballistic trajectory which has a horizontal component at least temporarily. At least part of the movement of the cushioning means towards the transport container thus takes place by the cushioning means flying ballistically in the direction of the transport container supplied, i.e. without being actively driven during this phase of movement. In order for the ballistic trajectory to be able to have a horizontal component, a dispense impulse, which at least also has a horizontal component, is required before the start of the ballistic flight phase. This dispense impulse is generated by the ejection device and its ejection function.

The fact that the cushioning means is at least also moved towards the transport container by a ballistic throwing process allows a very high speed of movement of the cushioning means, which already leads to a significant increase in the cycle times when filling transport containers with cushioning means. In addition, the cushioning means dispensing device is thus freed from the cushioning means that was previously held in a very short time, so that the cushioning means dispensing device can immediately receive another cushioning means that can then be dispensed next. This also ensures an increase in cycle times, so that due to the invention, a significantly higher number of transport containers can be supplied with cushioning means than was previously possible within a predetermined unit of time.

A development of the invention is characterized in that the ejection device comprises at least one air nozzle. This is easy to implement and very reliable, since such an air nozzle can very successfully apply the dispense impulse required for the ballistic trajectory to the cushioning means. Such an air nozzle works "contactlessly" so that the risk of the cushioning means being changed or even damaged by the application of the ejection impulse during ejection is low.

In principle, it is conceivable that the air nozzle continuously blows air and the cushioning means is ejected from the cushioning means dispensing device as soon as it is released by a corresponding device. It is more preferred, however, if the air nozzle is put into operation only for a very short time, namely in a pulsed manner, since this saves compressed air and thus energy.

It should be mentioned at this point that other means are also conceivable by means of which the cushioning means can be ejected from the cushioning means dispensing device, which other means thus function as an ejection device. For example, the use of a bolt biased by a spring or an electromagnetically actuated ejection element is conceivable.

It is also advantageous for the cushioning means dispensing device to comprise a gripping device for releasably gripping the cushioning means. The cushioning means dispensing device thus has the possibility of a double function because it not only allows the cushioning means to be dispensed, but can also grip the cushioning means beforehand at a first location, for example, and move it to a second location that is suitable for dispensing. In addition, active gripping of the cushioning means by the cushioning means dispensing device ensures defined holding and therefore facilitates reproducible ejection and thus a reproducible ballistic trajectory.

It is structurally simple if the gripping device comprises a lower rigid gripping jaw and an upper pivotable gripping jaw. In addition, the rigid lower gripping jaw can serve as a "starting ramp" for the cushioning means which facilitates ejection in a specific and desired direction.

It is particularly preferable for the device to comprise a robot having a robot arm on which the cushioning means dispensing device is arranged. In this way, the cushioning means dispensing device can be positioned very easily and in almost any manner for the transfer of the cushioning means. In connection with the gripping device mentioned above, the cushioning means dispensing device can also be used to grip the cushioning means at almost any location and to move it to a desired dispense location.

A further development is characterized in that the device comprises a cushioning means supply device for supplying the cushioning means, the cushioning means supply device preferably being designed for supplying a cushion pad made of a crumpled paper material. Such cushioning means supply devices are known from the market. Usually, a starting material that is initially in sheet form is first folded over at the edges by such a cushioning means supply device and then crumpled in a crumpling device by compression in the axial direction, and finally cut into discrete cushion pads by a cutting device. In principle, however, other cushioning means supply devices are also conceivable which supply other types of cushioning means, for example foam pads or the like.

A further development is characterized in that the transport container supply device comprises a conveying device which positions the transport container relative to the cushioning means dispensing device depending on a height of the transport container. The conveyor can comprise, for example, a driven conveyor belt or a series of driven conveyor rollers. The conveying device makes it possible for the cushioning means dispensing device to always be in the same position in absolute terms when the cushioning means is being dispensed, even when the transport containers are of different heights. Due to the relative positioning of the transport container, which is instead dependent on the height of the transport container, the transport container is always brought to the location at which the cushioning means reaches the transport container at the end of the ballistic trajectory known, for example, from calculations or from tests.

The invention also includes a method for moving a cushioning means towards a transport container, the method comprising the following steps: a. supplying the transport container; b. positioning a cushioning means dispensing device relative to the shipping container; and c. ejecting the cushioning means out of the cushioning means dispensing device such that the cushioning means moves in the direction of the supplied transport container along a ballistic trajectory which has a horizontal component at least temporarily. Advantages of this method correspond to those of the device described above.

In a development, it is proposed that the transport container and the cushioning means dispensing device, preferably in the horizontal direction, are positioned relative to one another depending on a height of the transport container. This ensures that the cushioning means reliably reaches the transport container at the end of the ballistic trajectory, regardless of the height of the transport container.

In a development, it is proposed that the horizontal distance between the transport container and the cushioning means dispensing device is greater in the case of a transport container with a lower height than in the case of a transport container with a greater height. This allows the cushioning means to be reliably moved directly into the transport container.

An embodiment of the invention will now be explained with reference to the accompanying drawings, in which.

Figure 1:
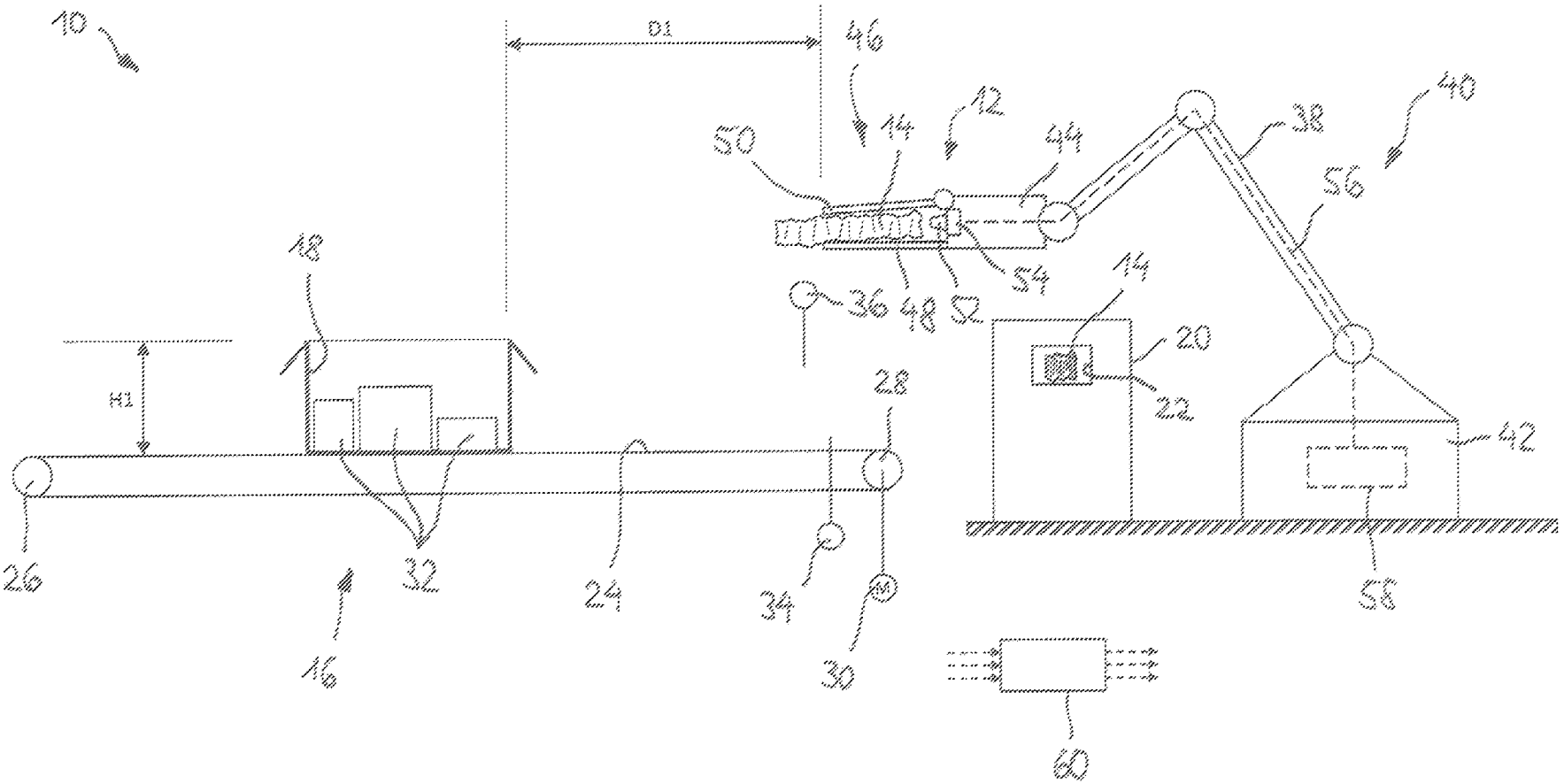
FIG. 1 is a schematic side view of a device for moving a cushioning means into a transport container at a first point in time.

A device for moving a cushioning means towards a transport container generally has the reference sign 10 in the drawings. Said device comprises a cushioning means dispensing device 12, by means of which a cushioning means 14 can be dispensed, and a transport container supply device 16, by means of which a transport container 18 that is open at the top can be supplied.

The cushioning means 14 is supplied by a cushioning means supply device 20. In the present case, the cushioning means 14 is, for example, an elongate cushion pad made of a crumpled paper material. This is produced by the cushioning means supply device 20 by a flat starting material in sheet form being fed to said device. When the starting material is fed in, it is folded over at the edges, and this folded-over intermediate product is then fed to a crumpling device (not shown). In this crumpling device, the intermediate product is compressed in the axial direction, as a result of which it is crumpled.

At the end of the production process, the string of crumpled paper material is cut into discrete elongate cushion pads 14 by means of a cutting device (also not shown), which are supplied in an output region 22 of the cushioning means supply device 20. The output region 22 can comprise a slightly downwardly sloping and centrally slotted output chute (not shown), at the end of which there is a stop by means of which the cushion pad or cushioning means 14 supplied is removably held, as will be explained further below.

In principle, however, other cushioning means supply devices are also conceivable which supply other types of cushioning means, for example cushion pads made of a plastics foam, etc.

In the present case, the transport container supply device 16 comprises a conveyor belt 24, which is spanned between two deflection rollers 26 and 28. The deflection roller 28 on the right in the drawings can be driven by an electric motor 30. In this way, the transport container 18 standing on the conveyor belt 24 can be conveyed and positioned at a desired location, as will be explained in greater detail below. In principle, other types of transport container supply devices are also conceivable, for example driven roller conveyors or the like.

The transport container 18 in turn is a cardboard box, for example, but other transport containers are also conceivable, for example made of plastics material. In the present case, three objects 32 are arranged in the transport container 18, which objects are secured in the transport container 18 by the cushioning means 14 and, after the transport container 18 has been closed, are to be transported to a recipient.

A sensor 34 detects when the transport container 18 is conveyed past the sensor 34 by the conveyor belt 24. A sensor 36 detects a current height of the transport container 18.

The cushioning means dispensing device 12 is arranged on a projecting end of a robot arm 38 of a robot 40 which has a plurality of articulations. The robot arm 38 can also be rotated relative to a base 42 of the robot 40 about a vertical axis.

The cushioning means dispensing device 12 comprises a base portion 44, on which a gripping device 46 is arranged at the end thereof pointing away from the robot arm 38. This gripping device in turn comprises a lower gripping jaw 48 which is rigid relative to the base portion 44 and an upper gripping jaw 50 which can be pivoted in a motorized manner relative to the base portion 44 about a horizontal axis. For example, a pneumatic cylinder (not shown) can be used for the motorized movement of the gripping jaw 50, but in principle an electromotive movement of the gripping jaw 50 is also conceivable, for example.

The cushioning means dispensing device 12 also includes an ejection device 52 in the form of an air nozzle, which is arranged on the base portion 44 and, as will be explained further below, can generate an air jet directed into the region between the two gripping jaws 48 and 50. For this purpose, the air nozzle 52 can be connected to a compressed air supply 58, shown in broken lines in the drawings, via an electromagnetically actuated switching valve 54 and a compressed air line 56, also shown in broken lines in the drawings.

The operation of the device 10 is controlled overall in an open-loop and closed-loop manner by an open-loop and closed-loop control device 60. For this purpose, the open-loop and closed-loop control device 60 receives signals from various sensors, for example from the sensors 34 and 36 mentioned above. The open-loop and closed-loop control device 60 controls, for example, the electric motor 30 of the transport container supply device 16, the cushioning means supply device 20, the robot 40, the motor drive of the upper gripping jaw 50 and the switching valve 54.

The device 10 is operated as follows: the cushioning means supply device 20 arranged at the side of the conveyor belt 24 and the base 42 of the robot 40 is controlled by the open-loop and closed-loop control device 60 such that said supply device supplies a cushioning means 14 in the form of a discrete cushioning pad at the output region 22. The robot 40 and the gripping device 46 are controlled by the open-loop and closed-loop control device 60 such that the upper gripping jaw 50 is pivoted upward and the gripping device 46 is moved to the output region 22 of the cushioning means dispensing device 12.

There, the cushioning means 14 supplied on the transfer chute is gripped by the upper gripping jaw 50 swiveling down again and the cushioning means 14 thus being clamped between the two gripping jaws 48 and 50. The above-mentioned slot in the transfer chute allows the gripping device 46 to grip the cushioning means 14 lying on the transfer chute and to lift it upward beyond the provided stop. For this purpose, the lower gripping jaw 48 has a smaller width than the slot is wide so that it can pass through the slot (of course, the cushioning means 14 must accordingly have a greater width than the slot is wide).

Alternatively, the above-mentioned stop on the transfer chute can also be retracted for the removal process, so that the gripping device 46 can remove the cushioning means 14 from the dispensing region 22 without having to lift it up over the stop. This would again save time. The robot 40 is now controlled such that the gripping device 46 or the cushioning means dispensing device 12 are moved into the dispensing position shown in FIG. 1.

During this time, the transport container 18 was conveyed by the conveyor belt 24 to a desired and very specific position, namely the position shown in FIG. 1. For this purpose, the open-loop and closed-loop control device 60 receives a signal when the transport container 18 is moved past the sensor 34 on the conveyor belt 24. Since the open-loop and closed-loop control device 60 knows the speed of movement of the conveyor belt 24, the electric motor 30 is controlled by the open-loop and closed-loop control device 60 after receiving the signal from the sensor 34 until the transport container 18 is in the desired position, namely at a horizontal distance D1 from the gripping device 46 in the example in FIGS. 1 and 2. The electric motor 30 and thus the conveyor belt 24 are then stopped.

Figure 2:
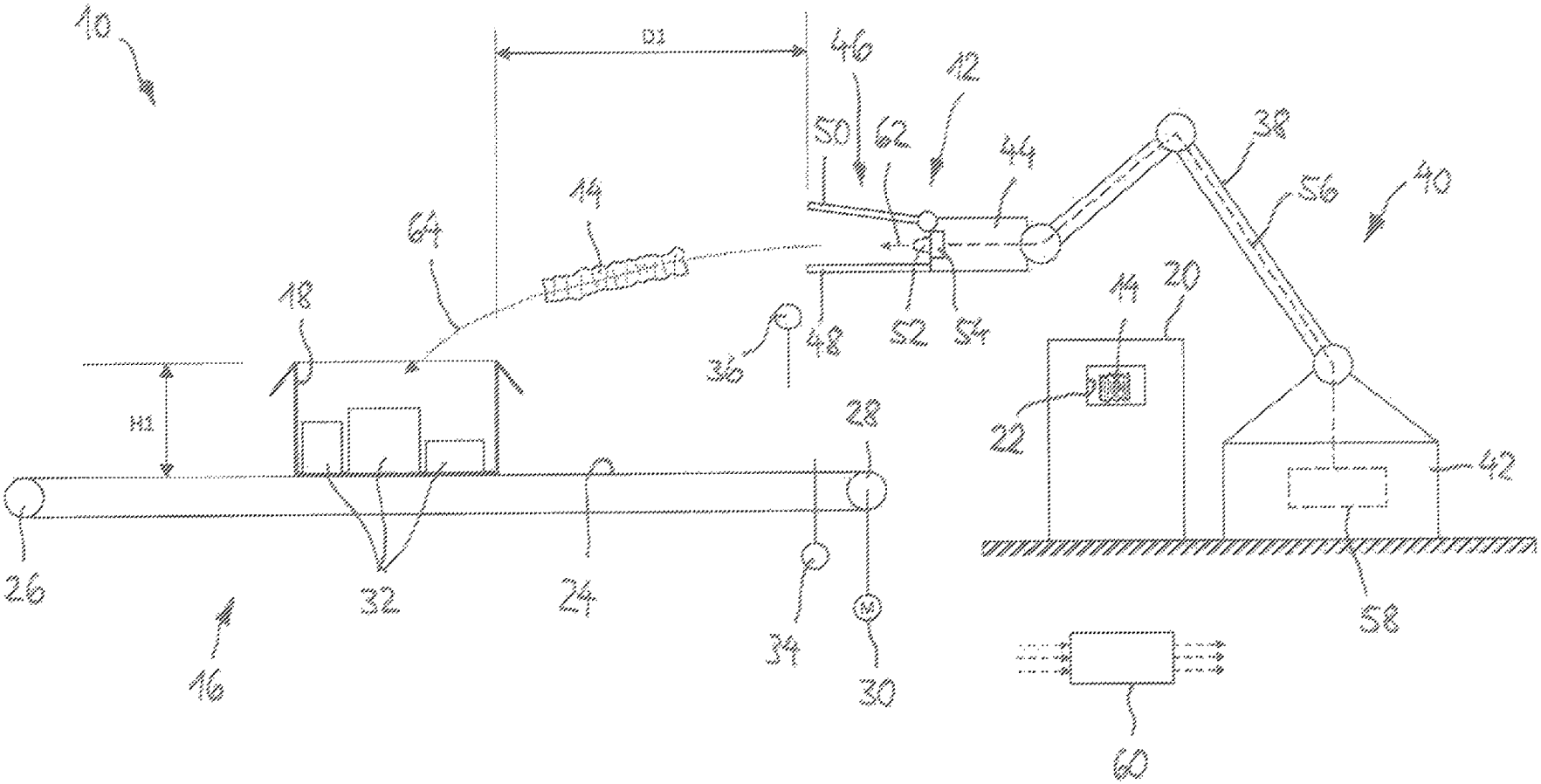
FIG. 2 is a view similar to FIG. 1 at a second point in time.

This desired position is determined and specified by the open-loop and closed-loop control device 60 depending on the height of the transport container 18. For this purpose, data records are stored in a memory of the open-loop and closed-loop control device 60, or a characteristic curve is stored which links the height of the transport container 18 and the associated position of the transport container 18 relative to the gripping device 46. In the example of FIGS. 1 and 2, this height is H1.

A certain pressure is continuously provided in the compressed air line 56 upstream of the initially closed switching valve 54 by means of the compressed air supply 58. As can be seen from FIG. 2, the open-loop and closed-loop control device 60 swivels the upper gripping jaw 50 upwards and therefore the cushioning means 14 is released by the gripping device 46. The open-loop and closed-loop control device 60 also opens the switching valve 54, as a result of which a substantially horizontal air jet is generated in a pulsed manner, which is indicated in FIG. 2 by an arrow 62.

This air jet 62 acts on the now released cushioning means 14 and ejects it from the cushioning means dispensing device 12 such that it moves along a ballistic trajectory 64, represented by a dotted arrow in FIG. 2, towards and into the transport container 18. It can easily be seen from FIG. 2 that this ballistic trajectory 64 has a horizontal component, but in the course of the movement towards the transport container 18, due to the gravity acting on the cushioning means 14, it also has a vertical component that is increasing in size and is directed downwards. In this respect, the ballistic trajectory 64 has the classic parabolic shape.

In this way, the cushioning means 14 arrives directly from the cushioning means dispensing device 12 and without diversions into the transport container 18, without any manual handling of the cushioning means 14 and/or the transport container 18 being necessary. As soon as the cushioning means 14 has entered the transport container 18, the conveyor belt 24 is set in motion by actuation of the electric motor 30 by the open-loop and closed-loop control device 60 and the transport container 18 is conveyed away for further processing, for example for closing.

During this time, the gripping device 46 is already moved again by the robot 40 to the output region 22 of the cushioning means dispensing device 12, where a new cushioning means 14 has already been produced and supplied in the meantime. Another transport container 18 is likewise immediately positioned at a desired location by the transport container supply device 16, so that a next cushioning means 14 can be moved into the further transport container 18 immediately.

Figure 3:
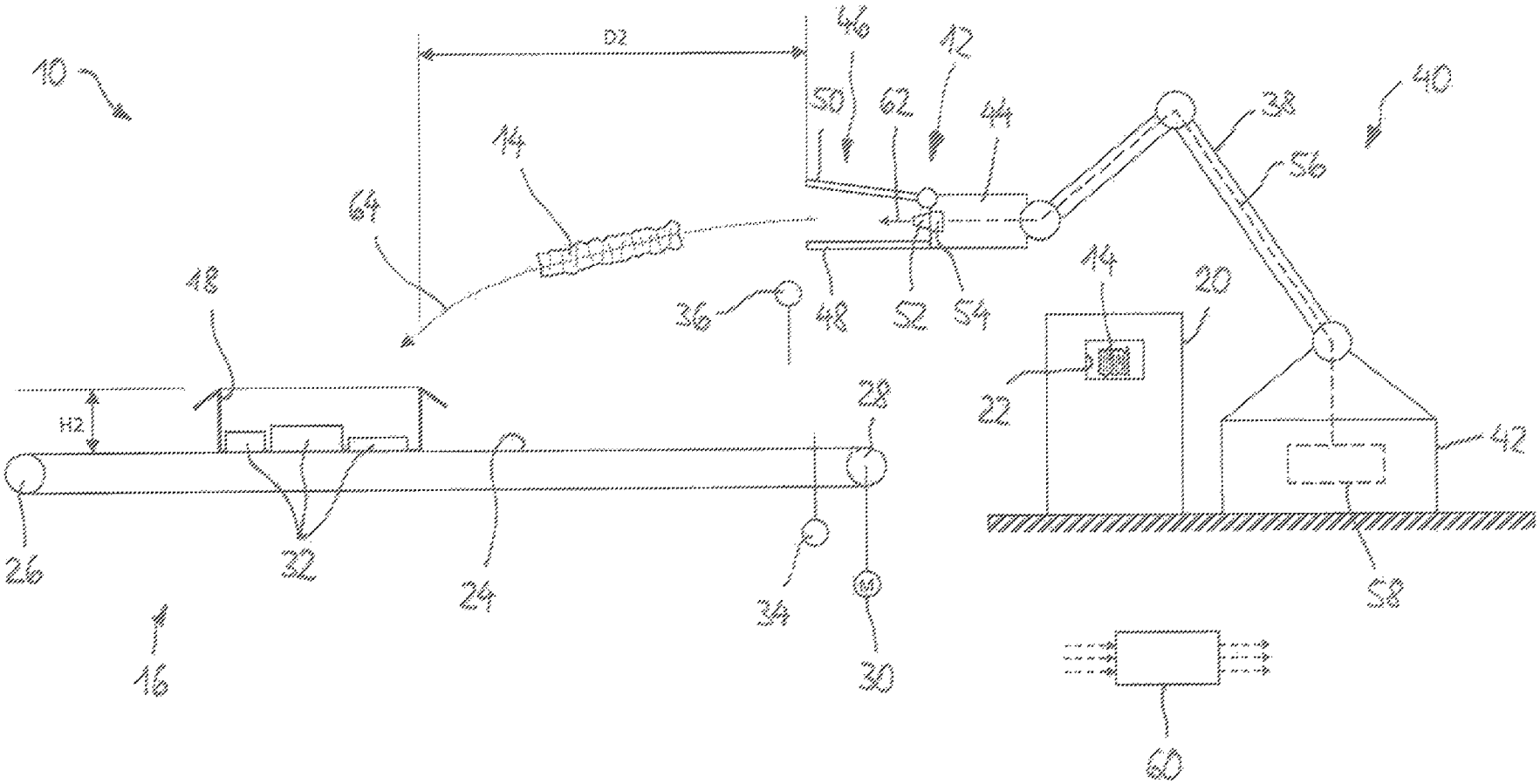
FIG. 3 is a view similar to FIG. 2, in which the transport container has a lower height than the transport container in FIGS. 1 and 2.

FIG. 3 shows the process shown in FIG. 2 for a transport container 18 which has a lower height than the transport container 18 in FIG. 2, namely a height H2. It should be noted at this point that the elements and regions in FIG. 3 which have equivalent functions to elements and regions already described above have the same reference signs in FIG. 3 as in FIGS. 1 and 2 and are not described again.

It can be seen from FIG. 3 that in order to dispense the cushioning means 14, the cushioning means dispensing device 12 has been positioned identically as in FIGS. 1 and 2. However, the transport container 18 was positioned at a horizontal distance D2 from the gripping device 46 which is greater than the horizontal distance D1 in FIGS. 1 and 2. It can be seen that the trajectory 64 now, due to the greater horizontal distance D2, leads the cushioning means 14 directly into the transport container 18 despite the same position of the cushioning means dispensing device 12.

The invention claimed is:

1. Device for moving a cushioning means towards a transport container, comprising a cushioning means dispensing device for the cushioning means and a transport container supply device for supplying the transport container, wherein the cushioning means dispensing device has an ejection device which ejects the cushioning means out of the cushioning means dispensing device such that the cushioning means moves towards the supplied transport container along a ballistic trajectory which has a horizontal component at least temporarily, wherein the cushioning means dispensing device comprises a gripping device for releasably gripping the cushioning means, wherein the gripping device comprises gripping jaws.

2. Device according to claim 1, wherein the ejection device comprises at least one air nozzle.

3. Device according to claim 1, further comprising a cushioning means supply device for supplying the cushioning means, the cushioning means supply device being designed for supplying a cushion pad made of a crumpled paper material.

4. Device according to claim 1, wherein the transport container supply device comprises a conveying device which positions the transport container relative to the cushioning means dispensing device depending on a height of the transport container.

5. Device for moving a cushioning means towards a transport container, comprising a cushioning means dispensing device for the cushioning means and a transport container supply device for supplying the transport container, wherein the cushioning means dispensing device has an ejection device which ejects the cushioning means out of the cushioning means dispensing device such that the cushioning means moves towards the supplied transport container along a ballistic trajectory which has a horizontal component at least temporarily, wherein the cushioning means dispensing device comprises a gripping device for releasably gripping the cushioning means, wherein the gripping device comprises a lower rigid gripping jaw and an upper pivotable gripping jaw.

6. Device for moving a cushioning means towards a transport container, comprising a cushioning means dispensing device for the cushioning means and a transport container supply device for supplying the transport container, wherein the cushioning means dispensing device has an ejection device which ejects the cushioning means out of the cushioning means dispensing device such that the cushioning means moves towards the supplied transport container along a ballistic trajectory which has a horizontal component at least temporarily, wherein the cushioning means dispensing device comprises a gripping device for releasably gripping the cushioning means, further comprising a robot having a robot arm on which the cushioning means dispensing device is arranged.

7. Method for moving a cushioning means towards a transport container, comprising the following steps:

a. supplying the transport container;

b. positioning a cushioning means dispensing device relative to the transport container; and c. ejecting the cushioning means out of the cushioning means dispensing device such that the cushioning means moves towards the supplied transport container along a ballistic trajectory which has a horizontal component at least temporarily, the cushioning means being unconstrained by any conveying device between the dispensing device and the transport container such that the cushioning means travels freely through the air between the dispensing device and the transport container along the ballistic trajectory, wherein the transport container and the cushioning means dispensing device, preferably in the horizontal direction, are positioned relative to one another depending on a height of the transport container.

8. Method for moving a cushioning means towards a transport container, comprising the following steps:

a. supplying the transport container;

b. positioning a cushioning means dispensing device relative to the transport container; and c. ejecting the cushioning means out of the cushioning means dispensing device such that the cushioning means moves towards the supplied transport container along a ballistic trajectory which has a horizontal component at least temporarily, wherein the transport container and the cushioning means dispensing device, preferably in the horizontal direction, are positioned relative to one another depending on a height of the transport container, wherein the horizontal distance between the transport container and the cushioning means dispensing device is greater in the case of a transport container with a lower height than in the case of a transport container with a greater height.

* * * * *